US006348293B1

(12) United States Patent
Verbeeck et al.

(10) Patent No.: US 6,348,293 B1
(45) Date of Patent: Feb. 19, 2002

(54) RADIOGRAPHIC FILM MATERIAL EXHIBITING INCREASED COVERING POWER AND "COLDER" BLUE-BLACK IMAGE TONE

(75) Inventors: Ann Verbeeck, Begijnendijk; Johan Loccufier, Zwijnaarde; Govert De Baecke, Kalken; Freddy Henderickx, Olen, all of (BE); Heinrich Odenwälder, Leverkusen (DE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/715,020

(22) Filed: Nov. 20, 2000

Related U.S. Application Data

(60) Provisional application No. 60/169,268, filed on Dec. 7, 1999.

(30) Foreign Application Priority Data

Nov. 26, 1999 (EP) ..... 99204011

(51) Int. Cl.[7] ..... G03C 1/035; G03C 1/35; G03C 5/117

(52) U.S. Cl. ..... 430/139; 430/368; 430/502; 430/564; 430/965; 430/966; 430/967

(58) Field of Search ..... 430/139, 368, 430/502, 965, 966, 564

(56) References Cited

U.S. PATENT DOCUMENTS 4,760,015 A * 7/1988 Berthold et al. ..... 430/965
5,190,855 A 3/1993 Toya et al. ..... 430/599
5,700,630 A 12/1997 Inoue et al. ..... 430/399
5,759,759 A 6/1998 Adin et al. ..... 430/966

FOREIGN PATENT DOCUMENTS

EP 0 508 390 10/1992
EP 0 890 874 1/1999
EP 0 953 867 11/1999

OTHER PUBLICATIONS

Derwent Publications Ltd., London, GB, Section Ch, Week 199605, Class E12, AN 1996–046740, XP002137754 & JP 07 311436 A (Fuji Photo Film Co. Ltd.), Nov. 28, 1995, Abstract.

Derwent Publications Ltd., London, GB, Section PQ, Class P83, AN 1988–217688, XP002137764 & JP 63 155140 A (Konica Corporation), Jun. 28, 1988, Abstract.

* cited by examiner

*Primary Examiner*—Richard L. Schilling
(74) *Attorney, Agent, or Firm*—Breiner & Breiner, L.L.C.

(57) ABSTRACT

A radiographic film material is described including a transparent film support having first and second major surfaces coated with a subbing layer, optionally overcoated with an antihalation undercoat. Coated adjacent on each side of the film support is a light-sensitive silver halide emulsion overcoated with a protective antistress layer. The emulsion layer has chemically and spectrally sensitized {111} tabular hexagonal grains or crystals, having silver iodide in an amount of at most 3 mole %, based on silver, covering at least 50% of the total projective surface of all grains, having an average grain thickness of less than 0.30 $\mu$m. The antistress layer, or the optional antihalation undercoat or both includes a N-amino mercapto-triazole compound containing one or more alkali soluble group(s). A radiographic screen/film combination is also described including the film material.

9 Claims, No Drawings

RADIOGRAPHIC FILM MATERIAL EXHIBITING INCREASED COVERING POWER AND "COLDER" BLUE-BLACK IMAGE TONE

The application claims the benefit of U.S. Provisional Application Ser. No. 60/169,268 filed Dec. 7, 1999.

FIELD OF THE INVENTION

The present invention relates to a radiographic light-sensitive silver halide film material, a screen/film system with intensifying screens relied thereupon and a black-and-white image forming method.

BACKGROUND OF THE INVENTION

Since the early eighties practical use of light-sensitive tabular silver halide grains or crystals has become common knowledge for anyone skilled in the art of photography. From Eastman Kodak's basic patents relied thereupon those related with the preparation of {111} tabular silver halide grains, sensitivity increase by spectral and chemical sensitization, and coating in a light-sensitive silver halide photographic material, more particularly in a forehardened duplitized radiographic material showing improved covering power for tabular grains having a thickness of less than 0.20 $\mu$m as described in U.S. Pat. No. 4,414,304 and in the patents corresponding therewith in Japan and in the European countries, it becomes clear that problems encountered by making use of such grains are related with image tone as has also been set forth in U.S. Pat. No. 5,595,864.

In radiographic applications the film materials are coated with relatively high amounts of silver, in order to provide a suitable sensitometry even if a low radiation dose is applied to the patient as is always desirable. Although the use of {111} tabular silver halide grains permits coating of lower amounts of silver, if compared e.g. with grains having a more globular shape as applied before practical application of said tabular grains, there remains the need to provide an acceptable image tone after development of materials having light-sensitive silver halide layers containing said tabular grains. Reduction of thickness of the {111} tabular grains coated in a radiographic film material hitherto, although providing a higher covering power, remains unambiguously related indeed with the occurrence, after processing of such materials, of diagnostic images having an unacceptable reddish-brown image tone for radiologists as image tone and image quality are closely related with each other in the specific context of examination of diagnostic images.

Measures taken in order to get a shift in image tone from reddish-brown to the desired bluish-black color of the developed silver, well-known from the state-of-the-art are hitherto unsatisfactory. Coating light-sensitive emulsion layers on a blue base as in U.S. Pat. No. 5,800,976 makes increase minimum density, a phenomenon which is interpreted by the radiologist as an undesired increase of fog density. Incorporation in the other layers of the film material of such dyes or dye precursors providing blue color directly or indirectly (by processing and oxidative coupling reactions) are e.g. known from U.S. Pat. Nos. 5,716,769 and 5,811,229 and EP-A 0 844 520, and JP-A 10-274 824 respectively and causes the same problems as set forth hereinbefore, moreover showing, in the worst cases, staining of the screens with blue dyes diffusing from the material onto the screen and problems related with criticality of generation of imagewise developed blue colored silver and preservation characteristics of the material. It has however, untill now, been impossible to traverse the existing relationship between improved covering power and worse image tone.

OBJECTS OF THE INVENTION

It is a first object of the present invention to change the existing relationship between covering power and image tone for radiographic materials having tabular grain emulsions as set forth hereinbefore, thus providing an increased covering power and an increased image tone.

It is a second object of the present invention to avoid negative influences on development kinetics, i.a. developability due e.g. to the presence of chemical compounds inhibiting development to an unacceptable extent when present in the layers of the photographic material.

It is a further object of the present invention to provide improved preservation characteristics for the material.

It is still a further object of the present invention to prevent loss in sensitometric characteristics, especially speed and gradation.

Further objects will become apparent from the description hereinafter.

SUMMARY OF THE INVENTION

Therefore a radiographic film material has been disclosed comprising a transparent film support having first and second major surfaces coated with a subbing layer, optionally overcoated with a antihalation undercoat, further coated adjacent to said subbing layer or said antihalation layer, on each side of said film support a light-sensitive silver halide emulsion overcoated with a protective antistress layer, said emulsion layer having chemically and spectrally sensitized {111} tabular hexagonal grains or crystals having silver iodide in an amount of at most 3 mole %, based on silver, covering at least 50%, preferably at least 70% and most preferably at least 90% of the total projective surface of all grains, the said tabular grains having a mean equivalent volume diameter of from 0.3 $\mu$m up to 1.0 $\mu$m and an average grain thickness of less than 0.30 $\mu$m, wherein said film material is coated with a total amount of silver halide, expressed as an equivalent amount of silver nitrate of less than 7 g/m$^2$, characterized in that said protective antistress layer, said antihalation undercoat or both said protective antistress layer and said antihalation undercoat comprise, in an amount of at least 0.5 mmole per mole of silver halide coated, a N-amino mercapto-triazole compound having three N-atoms in a five membered heterocyclic ring, said ring being substituted with at least one unsubstituted or substituted —NR1R2 amino group, at least one mercapto group in form —SM, M representing a hydrogen atom, an alkali metal atom or an ammonium group; and a substituent R3, wherein R3 represents hydrogen, an unsubstituted or substituted alkylene, alkenylene, alkynylene, arylene, heteroarylene (optionally containing heteroatoms, aliphatic or aromatic rings), and wherein R1 and R2 together represent a double bond further independently substituted as R3 and wherein at least one of R1/R2 or R3 contains one or more alkali soluble group(s). Said five-membered ring is represented by formula (I)

(I)

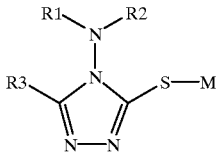

A radiographic screen/film combination or system has also been disclosed, said system comprising a radiographic film material according to the claims, sandwiched between a pair of supported or self-supporting X-ray intensifying screens, wherein said pair of supported or self-supporting X-ray intensifying screens comprises luminescent phosphor particles emitting at least 50% of their emitted radiation in the wavelength range for which said material has been made spectrally sensitive as well as a black-and-white image-forming method comprising the steps of contacting the film material as set forth with X-ray intensifying screens by putting it in a sandwich of a pair of said X-ray intensifying screens in order to get a radiographic screen/film combination as disclosed herein, exposing the film material to X-rays passing a subject to be examined, while being in contact with the said screens; and processing the film material by the steps of developing, fixing, rinsing and drying.

DETAILED DESCRIPTION OF THE INVENTION

It is an essential feature of the present invention to add to the protective antistress layers and/or to the antihalation undercoat layers, if present, of the radiographic double-side coated or duplitized material, besides the normally added components (see Examples) a N-amino mercapto-triazole compound as explained in the summary of the invention and presented in the general formula (I), in exceptionally huge amounts of at least 0.5 mmole per mole of coated silver, more preferred from 1 mmole up to 5 mmole and even more preferred up to an amount of 10 mmole per mole of coated silver halide. It has been established that the presence of such compounds in the non-light sensitive hydrophilic layers of the said radiographic material (as are the protective antistress layers and the optionally present antihalation undercoats between subbing layer and light-sensitive emulsion layer, both hydrophilic layers being coated adjacent to the light-sensitive silver halide emulsion layers) further improves image tone in that a "colder" blue-black image is obtained for at least the same and even an increased covering power.

Compounds having a structure according to the formula (I) have been given hereinafter (see formulae (I.1)–(I.3)):

(I.1)

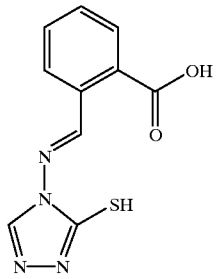

-continued (I.2)

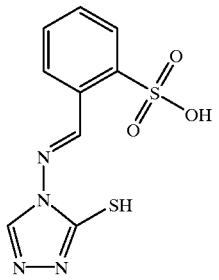

(I.3)

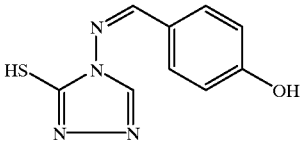

In a further preferred embodiment said compound present in one or more hydrophilic non-light-sensitive layers as set forth above in the material according to the present invention satifies formula (II) given hereinafter:

(II)

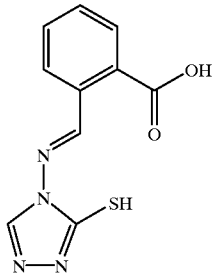

Other preferred N-amino mercapto-triazole compounds are represented hereinafter in the formulae (III.1–III.5):

(III.1)

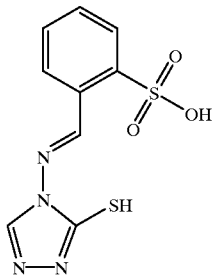

(III.2)

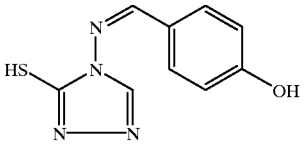

-continued (III.3)

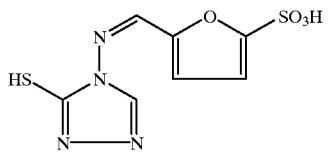

(III.4)

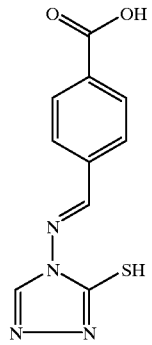

(III.5)

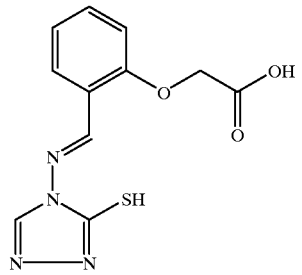

The protective antistress layers of the radiographic material according to the present invention may be the outermost layers of the material but an outermost afterlayer may be optionally present as disclosed e.g. in EP-A's 0 644 454 and 0 644 456, wherein e.g. a synthetic clay is present in favour of pressure resistance.

Moreover protective antistress layers may be coated as two adjacent layers, wherein one or both can be provided with at least one compound according to the general formula (I). It is however understood that in a preferred embodiment said the layer coated adjacent to the emulsion layer should include such a compound.

Protective antistress layers, besides their function as protection layer may include compounds providing better antistatic properties has been disclosed e.g. in EP-A 0 644 454 (with polyoxyalkylene compounds as antistatic agents), in EP-A's 0 505 626, 0 534 006 and 0 644 456. As said layers are in most cases outermost layers their contribution to satisfactory surface characteristics of the processed film material is very important, e.g. from the point of view of an excellent surface glare as desired by examining medecins, as has been described in EP-A 0 806 705 and in EP-A 0 992 845.

When a antihalation undercoat is present, as described in e.g. U.S. Pat. Nos. 5,077,184 and 5,693,370 the said compound according to the formula (I) is advantageously present therein, particularly if the said compound would be preferably absent in the protective anti-stress layers for whatever a reason and may be present therein if said compound is present in the said protective antistress layers.

It has been established now that the presence of N-amino mercapto-triazole compound, more preferably those satisfying formula (I), in one or more non-light-sensitive layers (like the protective antistress layers and/or antihalation undercoat layers) adjacent to the light-sensitive silver halide emulsion layers of the radiographic material of the present invention further improves image tone in that a "colder" blue-black image is obtained as desired by medecins examining radiographs for at least the same, and even an increased, covering power.

The light-sensitive (photosensitive) layers of the radiographic film material of the present invention coated on each of the major surfaces of the subbed support, optionally provided with a antihalation undercoat, thus contain chemically and spectrally sensitized {111} tabular hexagonal silver halide emulsion grains or crystals in an amount of at least 50%, more preferably at least 70% and most preferably at least 90% of the total projective surface of all grains, wherein the said tabular grains have a mean equivalent volume diameter of from 0.3 $\mu$m up to 1.0 $\mu$m and an average grain thickness of less than 0.30 $\mu$m, and more preferably from 0.05 $\mu$m up to 0.25 $\mu$m, wherein said film material is coated with a total amount of silver halide, expressed as an equivalent amount of silver nitrate of less than 7 g/m$^2$, more preferably from 3.0 up to 6.0 g/m$^2$.

Average grain volumes can be determined from calculations, after measurement for each individual grain of its volume determined after having applied electrochemical reduction techniques, wherein electrical signals thus obtained are related with silver halide grain volumes after total reduction thereof to metallic silver at the cathode of an electrochemical cell. The percentage of the total projective area of all tabular grains with respect to the total projective area of all grains present in the emulsion is calculated from electron microscopic photographs. Average grain diameters and thicknesses of the tabular grains are calculated after determination of individual grain thickness and diameter, calculated as equivalent circular diameter of the hexagonal surface, from shadowed electron microscopic photographs or scanning electron microscopic photographs. From the average ratios of (equivalent circular) diameter to thickness for each individual tabular grain aspect ratios are determined in order to get ability to further calculate the mean aspect ratio of the tabular grains in the emulsion distribution.

The radiographic film material according to the present invention comprises light-sensitive layers at both sides of the film support (whereby the film is called a double-side coated or "duplitized" film) wherein {111} tabular silver halide grains are preferably silver halide grains rich in silver bromide, containing silver iodide in limited amounts of at most 3 mole % and more preferably of at most 1 mole % in favour of developability, although there are no restrictions with respect to the halide composition: any combination of chloride, bromide and iodide (in the previously mentioned limited amounts), leading to {111} hexagonal tabular silver halide grains suitable for use in radiographic materials according to the present invention is possible. Said {111} hexagonal tabular grains present in the light-sensitive layers of the radiographic material of the present invention preferably have an average aspect ratio of 2 or more, preferably in the range from 5 to 20, an average grain thickness of less than 0.30 $\mu$m, more preferably from 0.05 $\mu$m up to 0.25 $\mu$m.

In a further preferred embodiment the {111} tabular grain population making part of a light-sensitive emulsion is homogeneous, i.e., has a variation coeffient of less and 0.40 and more preferably even from 0.10 up to 0.30, based on the equivalent circular diameters calculated for the individual {111} tabular grains.

Preparation methods for {111} tabular grain emulsions rich in silver bromide can be found in Research Dislosure No. 389057, p. 591–639 (1996), more particularly in Chapter I; No. 375042, published Jul. 1, 1995; No. 391021, published Nov. 1, 1996; No. 394023, published Feb. 1, 1997. A very useful method has been described in EP-A 0 843 208. In a preferred embodiment for use in the radiographic material according to the present invention {111} tabular hexagonal crystals rich in silver bromide are composed of silver bromoiodide or silver bromochloroiodide (composed of less than 10 mole % of silver chloride, based on silver). Iodide ions may be divided homogeneously or heterogeneously over the grain volume. When divided heterogeneously silver iodide may be present in one or more shells, divided over the grain volume. In a preferred embodiment however silver iodide is present at the surface of all {111} tabular hexagonal grains. Iodide ions can be provided in the preparation method by addition in a conversion step to silver halide grains of an inorganic iodide salt as potassium iodide to the reaction vessel. More preferred however as providing slower liberation of iodide in the reaction vessel is addition of organic agents releasing iodide ions in order to provide the low silver iodide concentrations, not exceeding 3 mole %, more preferably not exceeding 1 mole % and even more preferably not exceeding the range from 0.1 mole % up to 0.4 mole % based on silver over het whole grain volume. Addition of iodide by organic agents releasing iodide ions can proceed as described e.g. in EP-A's 0 561 415, 0 563 701, 0 563 708 and 0 651 284 and in U.S. Pat. Nos. 5,482,826 and 5,736,312. In an alternative method iodide ions can be released from iodate as has been described in U.S. Pat. No. 5,736,312. Release of iodide in the presence of a compound adjusting the rate of iodide release can be applied as described in U.S. Pat. No. 5,807,663. In another embodiment addition of iodide to emulsion grains rich in silver bromide and/or chloride is performed by adding fine preformed grains of silver iodide, optionally including bromide and/or chloride in minor amounts, said grains having a grain diameter of not more than 100 nm, and more preferably, not more than 50 nm. Such fine grains are so-called "Lippmann" emulsions. Addition of iodide making use from such fine grains rich in silver iodide has been described for the preparation of {111} tabular grains in JP-A's 04251241 and 08029904 and in EP-A's 0 662 632 and 0 658 805, wherein an outermost phase rich in silver iodide has been added to {111} tabular grains rich in silver bromide (optionally comprising up to less than 10 mole % of silver chloride). Addition of said fine AgI-Lippmann emulsions to the surface of the silver halide crystals in order to get a global iodide content of less than 1 mole % in the grain may advantageously proceed as disclosed in EP-A 0 475 191, wherein an excellent speed/fog ratio and a high covering power are attained. Not only in favour of image tone as set forth in the objects of the present invention but also in favour of developability it may be desirable for said tabular grains, when iodide is present, that all silver iodide is present at the grain surface thereof in an amount in order to get an average amount of iodide over the whole grain volume of less than 1 mole %. Said iodide at the grain surface of the tabular grains, present in order to get an average amount of iodide over the whole grain volume is then preferably present in an amount of at most 3 mole %, more preferably at most 1 mole % based on silver, preferably from 0.05 mole % up to 0.5 mole % of iodide, and even more preferred an average amount of iodide of 0.1 mole % up to 0.4 mole %.

Preparation methods for {111} tabular grain emulsions rich in silver chloride which can advantageously be used in the context of the present invention to be coated in the light-sensitive layers of the material as claimed can be found e.g. in EP-A's 0 481 133 and 0 678 772 and in Research Disclosure 388046, published Aug. 1, 1996. Preparation of such grains always require use of a crystal habit modifier in favour of stability of the [11planes as for AgC1 [100 planes are much more stable and as [111 planes easily tend to transform into [100 planes when no crystal habit modifying agent (such as adenine or another aminoazaindene compound) is present. Preparation of {111} tabular grain emulsions is commonly, as is known by anyone skilled in the art, performed in the presence of gelatin. In one embodiment the precipitation of the hexagonal {111} tabular silver halide crystals according to the present invention is performed in the presence of a protective, hydrophilic colloid, e.g. conventional lime-treated or acid treated gelatin but also oxidized gelatin (see e.g. EP-A 0 843 208) but even a synthetic peptizer may be used. The preparation of such modified gelatin types, when use would be made thereof, can be found in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium.

In another embodiment tabular silver halide grains used in emulsions for the materials according to the present invention are precipitated in the absence of gelatin by using colloidal silica sol as a protective colloid in the presence of an onium compound, preferably a phosphonium compound, as has been described in EP-A 677 773. Colloidal silica sol as a binder providing colloidal stability during all preparation steps can indeed be applied as a valuable alternative.

In order to controll the grain size, beside dyes (even spectral sensitizing dyes e.g.) or crystal habit modifiers, other grain growth restrainers or accelerators may also be used during the precipitation, together with flow rate variations and/or concentration variations of the silver and halide salt solutions, the temperature, pAg, physical ripening time, etc. Silver halide solvents such as ammonia, a thioether compound, thiazolidine-2-thione, tetra-substituted thiourea, potassium or ammonium rhodanide and an amine compound may be present during grain precipitation in order to further adjust the average grain size.

At the end of the precipitation the emulsion can be made free from excess of soluble inorganic salts by a conventional washing technique e.g. flocculation by ammonium sulphate or polystyrene sulphonate, followed by one or more washing and redispersion steps. Another well-known washing technique is diafiltration or ultrafiltration. Finally extra gelatin is added to the emulsion in order to obtain a gelatin to silver ratio which is optimized with respect to the coating conditions and/or in order to establish the required thickness of the coated emulsion layer. Preferably a gelatin to silver halide weight ratio ranging from 0.3 to 1.0, and more preferably around 0.5, may be envisaged in order to provide low amounts of gelatin to be coated in favour of e.g. rapid processing applicability for the coated materials.

It is clear that {111} tabular silver halide emulsion grains, present in light-sensitive emulsion layers of materials according to the present invention, should, besides being spectrally sensitized, also be chemically sensitized. Said chemical sensitization, preferably following spectral sensitization, preferably proceeds at least with a combination of labile sulphur compounds and gold compounds and more preferably with compounds providing sulphur, selenium or even tellurium and gold in favour of attainable sensitivity, also called speed. Chemical sensitization methods for {111} tabular grain emulsions which can be applied herein can be found in Research Dislosure No. 389057, p. 591–639 (1996), more particularly in Chapter IV. Very useful methods related therewith have been disclosed in EP-A's 0 443 453, 0 454 069, 0 541 104 and in U.S. Pat. Nos. 5,112,733 and 5,654,134. Useful labile selenium compounds suitable for use in the present invention have been disclosed in EP-A's 0 831 363, 0 889 354 and 0 895 121. Said labile selenium compounds are commonly applied in combination with sulphur and gold, and so are labile tellurium compounds as has been disclosed in EP-Application No. 99202439, filed Jul. 23, 1999.

The {111} tabular hexagonal silver halide emulsion grains present in light-sensitive emulsion layers of materials according to the present invention, are spectrally sensitized in the blue to near ultraviolet wavelength range and/or green wavelength range, depending on the requirements as set forth by medecins examining radiological images as especially sharpness (low cross-over percentage), but also contrast (which should be a "dedicated contrast" depending on the density range wherein image details should be discernable), speed and density range.

Preparation of spectrally and chemically sensitized tabular grains as may be applied to emulsion grains to be coated in light-sensitive layers of a radiographic material according to the present invention has been described in U.S. Pat. No. 4,439,520, wherein it has been established to perform spectral sensitization before chemical sensitization, so that the spectral sensitizer acts as a site-director for the sensitivity specks, generated during chemical sensitization. A broad review about spectral sensitization can be found in Research Dislosure No. 389057, p. 591–639 (1996), more particularly in Chapter V. Further useful information about additives which may be used in order to prepare emulsions to be coated in a material according to the present invention can be found in Research Dislosure No. 389057, p. 591–639 (1996), as in Chapter VII about antifoggants and stabilizers, in Chapter VIII about coating physical property modifying addenda, in Chapter XI about layer arrangements and in Chapter XV about supports.

In one embodiment according to the present invention the duplitized film material comprises in its light-sensitive emulsion layers coated on both sides of a subbed support an emulsion having {111} hexagonal tabular grains, spectrally sensitive to irradiation in the wavelength range shorter than 420 nm by the presence of at least one J-aggregating blue spectral sensitizer and of at least one dye selected from the group consisting of azacyanine dyes and monomethine cyanine dyes respectively as described hereinafter. The material according to the present invention thus has grains which have been made sensitive to the ultraviolet and/or blue range of the wavelength spectrum in that case.

A blue/ultraviolet absorbing dye combination of J-aggregating zeromethine dyes with monomethine or azacyanine sensitizing dyes absorbing blue/UV-radiation as described in EP-A 1 045 282 is particularly suitable for use when the radiographic material according to the present invention is applied in combination with a blue/UV-intensifying screen. Besides the favourable diagnostic value with respect to image quality thanks to a low fog level, a high overall contrast, an enhanced sharpness (low cross-over percentage) and absence of residual color, even in rapid processing cycles, as described therein, a particularly good image tone is provided offering cold black-bluish images as desired by the medical examiners, according to the objects of the present invention.

In the radiographic film material according to the present invention said film advantageously comprises as spectrally sensitizing J-aggregating dye for the {111} tabular silver halide grains in order to make them spectrally sensitive to irradiation in the said wavelength range shorter than 420 nm at least one selected zeromethine dye according to the formula (IV.1) or (IV.2) and at least one dye selected from the group consisting of monomethine cyanine dyes and azacyanine dyes.

(IV.1)

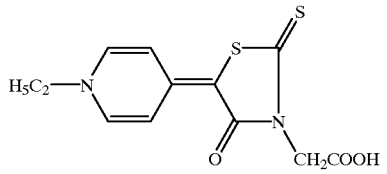

5-(1-ethyl-4(1H)-pyridylene)-4-oxo-2-thioxo-3-thiazolidine acetic acid (IV.2)

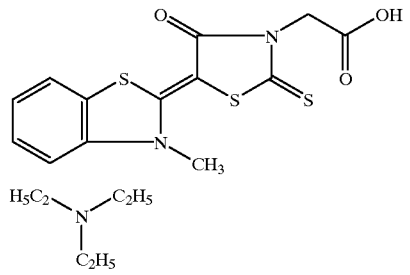

5-(3-methyl-3(3H)-benzothiazolylidene)-4-oxo-2-thioxo-3-thiazolidine acetic acid As is clear the J-aggregating blue-sensitizing dye or dyes according to the formulae (IV.1) and (IV.2) may be present alone, but are preferably present besides at least one dye selected from the group consisting of azacyanine dyes (the formulae of which are given hereinafter under the formulae (V) and monomethine cyanine dyes further given hereinafter (see formulae VI) in order to reach the objects of the present invention, thereby reducing dye stain after processing and improving speed moreover providing a suitable image tone if applied as spectrally sensitizing combination to the {111} hexagonal tabular silver halide, and particularly to the bromoiodide grains having all silver iodide at their grain surface in amounts of not more than 3 mole %, preferably not more than 1 mole %, and still more preferably from 0.1 up to 0.4 mole %, based on silver, over the whole grain volume.

Specific azacyanine dyes particularly suitable for use in the emulsions, materials and in the film-screen system according to the present invention are following, according to the formulae (V.1) and (V.2):

(V.1)

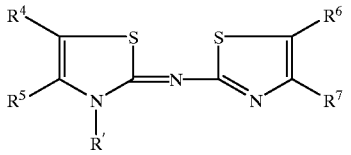

(V.2)

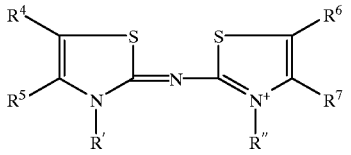

wherein each of the substituents R4–R7 independently represents hydrogen, an (unsubstituted or substituted) alkyl, an (unsubstituted or substituted) aryl or an (unsubstituted or substituted) aralkyl;

wherein R4 and R5 and/or R6 and R7 may form a (substituted or unsubstituted) benzoring, which, if substituted, has the same or different substituents as R4–R7;

wherein R' represents an (unsubstituted or substituted) alkyl, an (unsubstituted or substituted) aryl or an (unsubstituted or substituted) aralkyl group;

wherein R" represents hydrogen, an (unsubstituted or substituted) alkyl, an (unsubstituted or substituted) aryl or an (unsubstituted or substituted) aralkyl group;

and wherein cations or anions are present as charge compensating ions.

More particularly each of R and R' independently represents $(CH2)_N$H or $(CH2)_n$OH, n being an integer having a value from 1 to 4, $(CH2)_m$(SO3—) or $(CH2)_m$O(SO3—), m being an integer having a value from 2 to 4, (CH2)2CH(Y)SO3— wherein Y represents CH3—, —Cl or —OH;

$(CH2)_m$N(R)SO3— or $(CH2)_m$N(R')SO3—$(CH2)_N$(COO—) or $(CH2)_n$(COOH), $(CH2)_s$SO2— $(CH2)_t$H wherein s equals 2 or 3 and t equals 1 or 2;

$(CH2)_x$-Phen-W, wherein W represents —COO— or SO3—; Phen represents phenyl which is substituted or unsubstituted; and x equals 1, 2, 3 or 4, $(CH2)_n$CONHSO2R or $(CH2)_n$CONHSO2R', provided that R' may represent hydrogen as set forth hereinbefore or a latent solubilizing group as, e.g., $(CH2)_{m'}$—(C═O)—O—CH2—(C═O)—CH3, wherein m' is an integer having a value of from 1 to 5.

In order to get neutral azacyanine structures preferred charge compensating cations are Li+, Na+, K+, HN+Et3, wherein Et represents ethyl, whereas preferred charge compensating anions are Cl—, Br—, I—, —OTos, —OMes, CF3SO3—, wherein —OTos represents tosylate and —OMes represents mesylate.

Preferred (non-J-aggregating) monomethine cyanine dyes mentioned hereinbefore as an alternative for the (non-J-aggregating) azacyanine dyes according to the formulae (V.1) and (V.2), are those represented by the specific formulae (VI.1) and (VI.2) hereinafter, without however being limited thereto:

(VI.1)

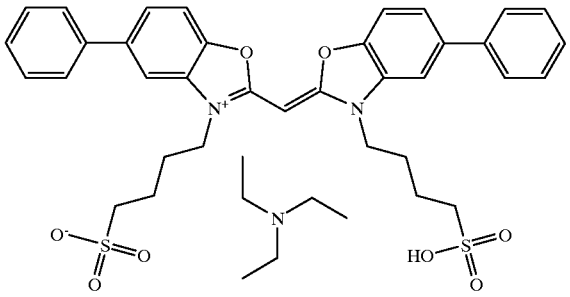

(VI.2)

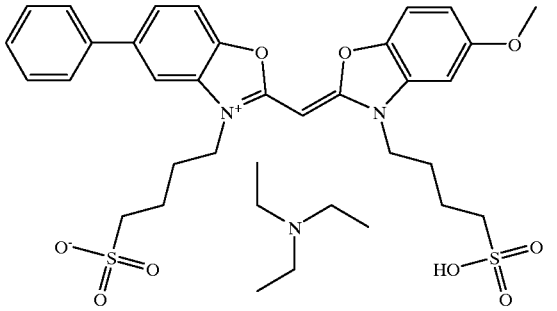

Said blue-sensitizing dye or dyes are added as first dye during the chemical ripening procedure, before addition of the chemical ripening compounds or agents. Mixtures of blue sensitizing J-aggregating zeromethine dyes as those according to formula (IV.1) and (IV.2) are particularly interesting from the point of view of an increased spectral response in form of speed, which can be achieved at lower total amounts of dyes as becomes clear from U.S. Pat. No. 5,707,794.

In another embodiment the material according to the present invention has grains which have been made sensitive to the green range of the wavelength spectrum. The film material as claimed thus has at least one emulsion comprising hexagonal {111} tabular silver halide grains, spectrally sensitive to irradiation in the wavelength range between 500 and 555 nm by the presence of at least one green sensitizing J-aggregating dye and of at least one dye selected from the group consisting of azacyanine dyes and trimethine cyanine dyes. The film then provides perfect matching with the screen emitting said radiation in the green wavelength range with a maximum around 540–545 nm as in a preferred embodiment absorption of radiation in the preferred green wavelength range by the {111} tabular silver halide grains is corresponding with at least 50% and more preferably at least 80% of the total radiation absorption by the said grains. Therefore in a preferred embodiment radiation-sensitive emulsions having {111} tabular hexagonal silver halide grains, as used in light-sensitive layers of materials according to the present invention, are made sensitive to irradiation in the wavelength range between 530 and 555 nm by the presence of a J-aggregating spectrally sensitizing cyanine dye. Preferred (orthochromatic) spectrally sensitizing dyes are J-aggregating dyes as described in EP-A 0 678 772 and 0 953 867, wherein e.g. trimethine benzoxazoles and imidazoles are used apart or in combination. In a particularly preferred embodiment said J-aggregating spectrally sensitizing dye is a 5,5'-dichloro-3,3'-bis(SO3-Q)-9-ethylbenzoxa-carbocyanine with Q being n-propylene or n-butylene and more particularly anhydro-5,5'-dichloro-3,3'-bis(n-sulphobutyl)-9-ethyl-oxacarbocyanine hydroxide or anhydro-5,5, -dichloro-3,3'-bis(n-sulpho-propyl)-9-ethyloxa-carbocyanine hydroxide. Furthermore green-light absorbing spectral sensitizers according to the formulae given in JP-A's 06-035104; 06-035101; 06-035102; 62-191847; 63-249839; 01-312536; 03-200246; U.S. Pat. No. 4,777,125 and DE 3,819,241 may be used. The right choice of said sensitizers or combinations thereof is always related with the purpose of obtaining the highest possible photographic speed while reducing dye stain after processing.

As it is a particularly favourable aspect for materials coated from emulsions having tabular grains in general, and more specifically for materials according to the present invention coated from emulsions having hexagonal {111} tabular grains to be coated with lower amounts of silver without loss of covering power in the material, the total amount of silver halide coated in said film material, expressed as an equivalent amount of silver nitrate, is less than 7 g/m$^2$, preferably in the range from 3 to less than 7 and even more preferably in the range from 3.0 to 6.0 g/m$^2$, e.g. about 4.5–5.0 g/m$^2$.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are, i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510 as well as cadmium salts and azaindene compounds.

At least one non-spectrally sensitizing dye can be added to an emulsion layer or to one or more non-light-sensitive hydrophilic layers such as the antihalation undercoat layers of the duplitized radiographic materials of the present invention, wherein said layers, if present, advantageously comprise N-amino mercapto triazole compounds having general formula (I). The presence of such dye(s) in adapted amounts is not only recommended to adjust the sensitivity of the different emulsion layers and eventually the required contrast, but also in order to reduce scattering of exposure radiation and thus to enhance sharpness. Preferred dyes are those that are removed easily from the photographic material during wet processing in order not to leave any residual color. It may particularly be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersion of water insoluble dyes having a mean particle diameter of less than 10 $\mu$m, more preferably less than 1 $\mu$m and still more preferably less than 0.1 $\mu$m. Examples of such dyes are disclosed in EP-A's 0 384 633; 0 351 593; 0 586 748; 0 587 230 and 0 656 401, EP-A's. 0 323 729; 0 274 723 and 0 276 566, and in U.S. Pat. Nos. 4,900,653; 4,904,565; 4,949,654; 4,940,654; 4,948,717; 4,988,611; 4,803,150 and 5,344,749. Said dyes can also be added in form of solid silica particle dispersions as has been disclosed in EP-A 0 569 074. Still another technique applied in order to obtain ultra fine dye dispersions consists in acidifying a slightly alkaline coating compo-sition "in situ" just before coating it onto the supporting layer. A more recent review of dispersion methods, useful in the context of the present application has been described in EP-A 0 756 201.

Not only film materials may contain such dyes in favour of image definition, but also presence thereof in intensifying screens may be advantageous as has been described in U.S. Pat. No. 5,381,015.

The silver halide emulsions used in light-sensitive layers of the material according to the present invention may also comprise compounds preventing the formation of a high minimum density or stabilizing the photographic properties during the production or storage of photographic materials or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethiosul-phinic acid and benzenethiosulphonic acid amide.

Other compounds which can be used as fog-inhibiting compounds are those described in Research Disclosure No. 17643 (1978), Chaptre VI. These fog-inhibiting agents or stabilizers can be added to the silver halide emulsion prior to, during, or after the ripening thereof and mixtures of two or more of these compounds can be used.

The binder of the layers, especially when gelatin is used therefore, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl-ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts.

Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitization and development acceleration. Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0 634 688 and 0 674 215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins and styrenes, or copolymers of the above with acrylic acids, methacrylic acids, unsaturated dicarboxylic acids, hydroxyalkyl (meth)acrylates, sulphoalkyl (meth)acrylates, and styrene sulphonic acids. Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 $\mu$m. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material according to the present invention may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides (see e.g. EP-A 0 890 874) or a polymer latex and the like or polymers providing permanent antistatic properties as polyethylene dioxythiophenes described e.g. in U.S. Pat. Nos. 5,312,681; 5,354,613 and 5,391,472; and in EP-A 1 031 875.

Said duplitized film materials for use in radiographic applications are irradiated by the light emitted imagewise by X-ray intensifying screens after conversion of X-ray radiation to the said light by luminescent phosphors-coated in the said screens or panels, in intimate contact therewith at both sides of the coated film support during X-ray exposure of part of a patient. A diagnostic silver image, in conformity with the X-ray image, is obtained after processing of the said film material.

During the X-ray irradiation said film is arranged in a cassette between two X-ray intensifying screens each of them making contact with its corresponding light-sensitive side, thus forming a film/screen system.

In one embodiment according to the present invention a radiographic screen/film combination or system has been provided, comprising a radiographic film material, sandwiched between a pair of supported or self-supporting X-ray intensifying screens, characterized in that i) said pair of supported or self-supporting X-ray intensifying screens essentially consists of luminescent phosphor particles emitting at least 50% of their emitted radiation in the wavelength range shorter than 420 nm, ii) said film comprises {111} tabular silver halide grains, spectrally sensitive to irradiation in the said wavelength range shorter than 420 nm by the presence of at least one J-aggregating blue spectral sensitizer and of at least one non-J-aggregating dye selected from the group consisting of azacyanine dyes and monomethine cyanine dyes.

As the radiographic film material as claimed has as least one emulsion comprising {111} tabular silver halide grains, spectrally sensitive to irradiation in the wavelength range shorter than 420 nm by the presence of at least one spectrally sensitizing dye as the one according to the formula (IV.1) or (IV.2) and of at least one dye selected from the group consisting of azacyanine and monomethine cyanine dyes according to the formulae (V.1–V.2) and (VI.1–VI.2) respectively, the film perfectly matches with the screen emitting said radiation in the wavelength range shorter than 420 nm as in a preferred embodiment of the present invention absorption of radiation in the said wavelength range shorter than 420 nm by the {111} tabular silver halide, preferably being bromo(chloro)iodide, grains is corresponding with at least 50% and more preferably at least 80% of the total radiation absorption by the said grains.

Luminescent phosphors suitable for use in a conventional intensifying screen of a radiographic film/screen system as the one according to the present invention must have a high prompt emission of fluorescent light on X-ray irradiation and low afterglow in favour of image sharpness. The relationship between resolution and speed of X-ray intensifying screens is described e.g. in Med. Phys. 5(3), 205 (1978). Specific intensifying screens emitting ultraviolet-blue radiation have e.g. been disclosed in U.S. Pat. Nos. 4,225,653; 4,387,141; 4,710,637; 5,112,700; 5,173,611 and 5,432,351; in EP-A's 0 650 089; 0 658 613; in PCT-Application WO 93/11457 and WO 95/15514. Typical blue-UV emitting phosphors therein are tantalates as described in PCT-Application WO 93/1521 and 93/1522, hafnates as described in U.S. Pat. No. 5,173,611 and fluorohalides (flourobromides) of barium and strontium as in WO 91/1357 and U.S. Pat. No. 5,629,125, doped with europium and co-doped with samarium as in U.S. Pat. Nos. 5,422,220 and 5,547,807 and even mixtures of tantalates and fluorohalides as in U.S. Pat. No. 5,077,145 and EP-A 0 533 234, replacing CaWO4 as representative for an older well-known generation of luminescent phosphors. Very useful phosphor particles have e.g. been disclosed in EP-A 0 820 069 wherein particles of niobium doped, monoclinic M, yttriumtantalate phosphor and particles of an europium doped bariumfluorohalide phosphor are composing the screen.

In the film/screen system according to the present invention preferred phosphor particles are niobium and gadolinium doped, monoclinic M, yttriumtantalate (MYT) phosphor corresponding to formula (VII):

$$YTaO4:Gd:Nb \quad (VII)$$

In another embodiment the radiographic film material has {111} tabular silver halide emulsions, preferably bromo (chloro) iodide emulsions, spectrally sentized with spectrally sensitizing dyes absorbing light in the green wavelength range.

In another embodiment according to the present invention a radiographic screen/film combination or system is thus provided comprising a duplitized film material, sandwiched between a pair of supported or self-supporting X-ray intensifying screens, characterized in that i) said pair of supported or self-supporting X-ray intensifying screens essentially consists of luminescent phosphor particles emitting at least 50% of their emitted radiation in the green wavelength range from 500 nm to 550 nm, ii) said film comprises {111} tabular silver halide grains, spectrally sensitive to irradiation in the said wavelength range from 500 to 550 nm by the presence of at least one J-aggregating green spectral sensitizer and of at least one the non-J-aggregating dyes selected from the group consisting of azacyanine dyes and monomethine cyanine dyes. In this film/screen system according to the present invention preferred phosphor particles are gadolinium oxysulfide phosphor particles corresponding to formula (VIII):

$$Gd2O2S:Tb \quad (VIII)$$

Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-Patent 1,489,398 and is suitable for use in the context of the film/screen system according to the present invention.

In the context of the present invention, more particularly with respect to the purposes to get reduced dye stain besides an excellent image tone, said reduced dye stain delivering an indispensible asset thereto, azacyanine dyes according to the general formulae (V.1) and (V.2) are advantageously used in the preparation of {111} tabular grain emulsions as the presence of said dyes permits further addition of J-aggregating spectral sensitizers in lower amounts, without loss in speed, thereby providing better decoloration in the processing. A survey of other useful chemical classes of J-aggregating spectral sensitizers suitable for use in spectrally sensitizing emulsions of the present invention has been described by F. M. Hamer in "The Cyanine Dyes and Related Compounds", 1964, John Wiley & Sons and other examples specifically useful for spectral sensitization of tabular grains have been given in Research Disclosure Item 22534 and in addition a more recent overview has been given in EP-A 0 757 285, wherefrom dyes forming J-aggregates on the flat surface of the {111} tabular hexagonal silver halide crystals are particularly useful. It is moreover preferred that the radiation-sensitive emulsion used in the material according to the present invention has one or more azacyanine dye(s) and (a) J-aggregating spectrally sensitizing dye(s), whether providing spectral sensitivity in the blue/UV or in the green light range in a ratio amount of more than 1:4 for a grain coverage exceeding 50%.

During X-ray irradiation of the radiographic film material of the present invention said film material (made sensitive to green or blue light by suitable spectral sensitization of its light-sensitive emulsion grains) is arranged in a cassette with two X-ray intensifying screens (emitting green or blue light by suitable luminescent phosphors) making contact with the silver halide emulsion layers at both sides of the film support. For chest radiography said cassette is provided with two X-ray intensifying screens making contact with two X-ray intensifying screens, being the same or different: it is indeed possible to use two identical screens (having same radiation sensitivity), to use two screens emitting the same irradiation but differing in speed, e.g. due to different coating amounts of phosphors (coating thickness), or even to use two intensifying screens having a different light emission. So combination of an intensifying screen sensitive to blue/UV-irradiation and a screen sensitive to green light may be favourable in order to attain desired properties with respect to sensitometry (desired sensitometric curve from the point of diagnostic view) and/or image quality (granularity and/or image definition, particularly sharpness).

Specific intensifying screens or conversion screens emitting green or blue light for use in the diagnostic image forming method according to the present invention are the commercially available X-ray generating devices providing an exposure to X-rays with a tube voltage e.g. from 70 kV up to 100 kV (as in chest radiography as an example of a more specific application of the present invention, without however limiting it thereto).

X-ray intensifying screens used in the screen/film systems according the present invention can be self-supporting or supported. X-ray intensifying screens in accordance with the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto.

A plastic film is preferably employed as the support material. Depending on the speed class of the screens for which a synergistic effect should be attained in the relation between speed and sharpness, supports characterized by their reflectance properties, expressed as % reflectance over the wavelength range from 350 to 600 nm, are particularly used as described e.g. in U.S. Pat. No. 5,381,015. Such supports can be highly light reflecting as e.g. polyethylene terephthalate comprising a white pigment, e.g. BaSO4, TiO2, etc., or it can be light absorbing supports, e.g. polyethylene terephthalate comprising a black pigment, e.g. carbon black. Supports comprising dyes or pigments that absorb light of a specific wavelength can also be useful in the preparation of X-ray intensifying screens in the film/screen system according to the present invention. In most applications the phosphor layers contain sufficient binder to give structural coherence to the layer. A mixture of two or more of these binders may be used, e.g., a mixture of polyethyl acrylate and cellulose acetobutyrate. The weight ratio of phosphor to binder is generally within the range of from 50:50 to 89:11, preferably from 80:20 to 89:11. The screen used in a screen/film system according to the present invention may comprise a supported layer of phosphor particles dispersed in a binding medium comprising one or more rubbery and/or elastomeric polymers as described in EP-A's 0 647 258 and 0 648 254. In this way a ratio by weight of pigment to binding medium of more than 90:10 and more preferably of at least 93:7, e.g. 98:2 can be obtained providing besides an excellent image resolution a high ease of manipulation as a result of a good elasticity of the screen and good adhesion properties between the support and the phosphor layer.

After the formation of the fluorescent layer, a protective layer is generally provided on top of the fluorescent layer. In a preferred embodiment the protective coating has a layer thickness d comprised between 1 and 50 $\mu$m and an embossed surface roughness is applied for high ease of manipulation, thereby avoiding sticking, friction and electrostatic attraction with maintenance of an excellent image resolution. The embossed protective layer can be provided on the phosphor layer in order to protect it against mechanical and chemical damage as described in EP-A's 0 510 753 and 0 510 754. Assemblies providing means for reducing cross-over to less than 10% for radiation longer than 300 nm in wavelength have been described e.g. in U.S. Pat. No. 5,259,016.

According to the present invention a black-and-white image-forming method has been provided comprising the steps of contacting the film material as claimed with X-ray intensifying screens by putting it in a sandwich of a pair of said X-ray intensifying screens in order to get a radiographic screen/film combination as described hereinbefore; exposing the film material to X-rays passing a subject to be examined, said X-rays (having an energy e.g. from 70 to 100 keV, without however excluding lower irradiation energies) while being in contact with the said screens; and processing the film material by the steps of developing, fixing, rinsing and drying.

The said processsing is preferably performed in an automatic processsing machine. More in detail for processing the film material of the present invention, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer (preferably) without hardening agent; fixing said material in a fixer, optionally without hardening agent; rinsing and drying said material.

A normally used configuration in the processing apparatus shows the following consecutive tank units corresponding with, as consecutive solutions: developer-fixer-rinse water. Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may als be present. As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342. Especially preferred developers comprising ecologically acceptable developing agents such as ascorbic acid and derivatives thereof have been described in EP-A 0 732 619 and in U.S. Pat. Nos. 5,593,817 and 5,604,082. Instead of or partially substituting (e.g. in a ratio by weight of from 1:1 up to 9:1) the ecologically questionable "hydroquinone" (iso)ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented. In order to reduce "sludge formation" which is favored by solubilizing agents like sulphites, present in the developer as preservatives, a particularly suitable developer solution is the one comprising a reduced amount of sulphite and ascorbic acid which acts as a main developer and anti-oxidant as well and which is called "low-sludge" developer. Suitable measures taken therefore have recently been described in the EP-Applications Nos. 99201891 and 99201892, both filed simultaneously Jun. 14, 1999.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868.

A particularly suitable fixer solution comprises an amount of less than 25 g of potassium sulphite per liter without the presence of acetic acid wherein said fixer has a pH value of at least 4.5, in order to make the fixer solution quasi odorless. If however aluminum ions are present in the fixer composition for whatever a reason, the presence of -ketocarboxylic acid compounds is recommended as has been described in EP-A's 0 620 483 and 0 726 491 as well as in RD 16768, published March 1978. It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated with reduced amounts of silver halide as in the present invention.

It is clear that although use of hexagonal {111} tabular emulsion grains in a duplitized material as in the present invention is claimed, it does however not exclude use of such emulsions in single-side coated materials, whether or not in radiographic applications (such as in combination with a single screen having luminescent phosphors with a high prompt emission of fluorescent light on X-ray irradiation and low afterglow in favour of image sharpness used in mammography, wherefore the relationship between resolution and speed of X-ray intensifying screens has been described e.g. in Med. Phys. 5(3), 205 (1978)). Other single-side coated materials wherein the emulsions can advantageously applied, e.g. with respect to preservation properties, developability, etc. are black-and-white silver halide material used e.g. in micrography, in aviation photography, in black-and-white cinefilms, in laserfilms or hardcopy films and in graphic or reprographic applications. Even use thereof in color photographic applications may be useful.

Having described in detail preferred embodiments of the present invention it is understood by a person skilled in the art that, within the scope of the present invention, it is not limited thereto, just as the following examples illustrating the present invention and the claims added thereafter.

EXAMPLES

While the present invention will hereinafter be described in connection with preferred embodiments thereof, it will be understood that it is not intended to limit the invention to those embodiments.

EXAMPLE 1

Preparation of Tabular Emulsion T

To a solution of 5.5 g of an oxidized gelatin in 3 l of demineralized water at 51° C., adjusted to a pH of 2.5 by adding H2SO4, stirred up to a rate of 600 r.p.m., were added by a double jet method aqueous solutions of 1.96 M AgNO3 (hereinafter referred to as A1) and 1.96 M KBr (hereinafter referred to as B1): 16 ml of A1 and 16 ml of B1 were added in a time interval of 30 seconds. During this period, the reaction mixture was maintained at 51° C. 6 minutes later pH was set to a value of 5.0±0.3 and immediately thereafter a solution of 50 g of inert gelatin in 500 ml of demineralized water of 70° C. was added. 6 minutes later B1 was added at a rate of 7.5 ml/min. during 28 seconds, followed during 1 minute by the simultaneous addition of A1 (at a rate of 7.5 ml/min.) and B1 (at a rate of 7.6 ml/min.). In a further double jet addition A1 and B1 were added during 2675 seconds at a linearly increasing rate going from 7.5 up to 15 ml/min. for A1 and from 7.6 up to 15.21 ml/min. in order to maintain a constant UAg potential of +10 mV in the reaction vessel. After 5 minutes A1 was added during 263 seconds at a rate of 7.5 ml/min. in order to increase the UAg value to 60 mV. At that moment a further double jet addition was performed for 100 seconds at a rate of 7.5 ml/min., whereafter the rate was increased linearly during 2518 seconds up to 36.8 ml/min. for A1 and up to 36.73 ml/min. for B1 in order to hold a constant UAg potential of +60 mV in the reaction vessel.

When said double jet addition was running 4 minutes an amount of an emulsion, dissolved in 20 g of demineralized water at 40° C., having ultrafine (ca. 0.040 $\mu$m) 100% AgI crystals was added to the reaction vessel in order to get a total AgI content at the end of precipitation of 0.1 mole % vs. silver precipitated.

After a physical ripening time of 20 min. Stirring was ended in the reaction vessel.

The average grain size of the silver bromoioide tabular {111} emulsion grains thus prepared, expressed as equivalent volume diameter, was 0.59 $\mu$m, the average thickness was 0.14 $\mu$m.

To 3370 g of this emulsion, of which pH was adjusted to 5.5, were added consecutively 4 ml of a 10 wt.% KSCN solution, 0.2 ml of a $4.76\times10^{-3}$ M solution of sodium toluenethio-sulphonate in methanol, 1200 ml of a 0.25 wt. % solution of anhydro-5,5'-dichloro-3,3'-bis(n-propyl-3-sulphonate)-9-ethyl-benzoxa-carbocyanine triethylammonium salt, 7 mg sodium thiosulphate dissolved in 10 ml of demineralized water, followed 1 minute later by addition of 8 ml of a 0.001 wt. % solution of 2-carboxyethyl-N-benzothiazine selenide, 3 minutes later: 6.5 ml of a solution containing $1.456\times10^{-3}$ M chloro auric acid and $1.58\times10^{-2}$ M ammonium rhodanide, and finally 10 ml of a 1 wt. % solution of 1-(p-carboxyphenyl)-5-mercapto-tetrazole and this mixture was chemically ripened during about 4 hours at 50° C. in order to get the best fog-speed relationship afterwards after coating in a photographic material. After cooling, phenol was added as a preservative.

Coating of the Materials

Preparation of the Film Material

As stabilizers in the emulsion layer coatings 0.1 mmole of 1-(m-carboxymethylthioacetamido)-phenyl-5-mercaptotetrazole and 0.6 mmole of 5-methyl-1,2,4-triazolo-(1,5-A)-pyrimidine-7-ol were added per mole of silver. Resorcinol was added as hardener accelerator in an amount of 2.8 g per mole of Ag. Consecutively 0.5 g of polyglycol (MW=6000) was added as a development accelerator; 20 ml of polyoxyethylene surfactant H17C8-Phenyl-(O—CH2—CH2)8—O—CH2—COOH and in an amount of 140 mg (per mole of Ag) fluoroglucinol was added as a hardener stabilizer together with polymethyl acrylate latex (in an amount of 140% by weight, based on the amount of gelatin binder) which was used as a plasticizer. The thus prepared emulsion coating solutions were coated on a blue colored polyethylene terephthalate support (density of the support measured to be 0.200) in such an amount in order to give a coating weight of 2.75 g/m2 per side in terms of AgNO3 and 1.42 g of gelatin per m2 per side.

The following protective layer was coated thereupon (pH value: 6.25) at both sides:

Composition of the protective antistress layer

| | |
|---|---|
| Gelatin | 1.11 g/m$^2$ |
| Graft copolymer (1) | 14 mg/m$^2$ |
| Chromium acetic acid | 7.3 mg/m$^2$ |
| Compound (2) | 16 mg/m$^2$ |
| Compound (3) | 6.7 mg/m$^2$ |
| Mobilcer Q (MMM trademarked product) | 9 ml/m$^2$ |
| Compound (4) | 15 mg/m$^2$ |
| Compound (5) | 40 mg/m$^2$ |

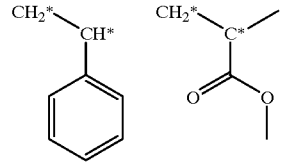

-continued

Composition of the protective antistress layer

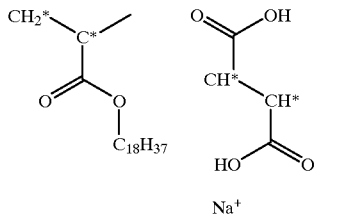

. . . Compound (1)

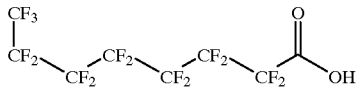

$NH_3$
Compound (2)

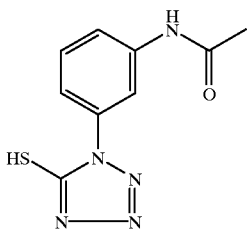

Compound (3)

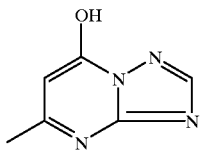

Compound (4)

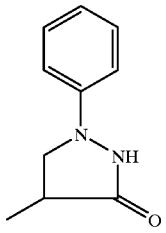

Materials have been numbered from 1 to 5, material MT1 representing a comparative material, wherein Emulsion T was coated without N-aminotriazole compound in the protective antistress layer and materials MT2–MT5 representing inventive materials wherein the same light-sensitive coating with Emulsion T was coated but wherein to the protective coating differing N-amino mercaptotriazoles according to the general formula (I) were added, according to the formulae as set forth in the Table 1 hereinafter in an amount of 12 mg/m2.

Samples of these coatings were exposed with green light of 540 nm during 0.1 seconds using a continuous wedge and were processed The processing was run in the developer G138i, trademarked product from Agfa-Gevaert N. V., Mortsel, Belgium, followed by fixing in fixer G334i, trademarked product from Agfa-Gevaert N. V., Mortsel, Belgium,and rinsing at the indicated temperature of 35° C. for a total processing time of 90 seconds.

Sensitometric and other useful parameters given in Table 1 are

Fog "F", given as an integer after having multiplied the real fog density as measured with a factor of 1000;

Speed "S", given as an integer after having multiplied the sensitivity measured at a density of 1.00 above minimum density as measured with a factor of 100; an decrease of speed with a figure of 30 corresponding with a doubling in speed;

Image tone "IT", evaluated from figures corresponding with Dr, wherefore data are summarized with respect to the density Dr measured through a red filter at a blue density Db=2: the higher this value (figure multiplied by a factor of 100), the better (more desired blue-black instead of undesired red-brown) is the color of the developed silver.

Covering power "CP", given as maximum density as measured after subtraction of the density of the support, multiplied with a factor of 100, further divided by the coating amount of silver, expressed as silver nitrate;

TABLE 1

| Matl. | Compound | F | S | IT | CP | AgNO3/m2 |
|---|---|---|---|---|---|---|
| MT1 (comp.) | NO | 208 | 157 | 193 | 76 | 5.03 g |
| MT2 (inv.) | (II) | 208 | 158 | 196 | 78 | 5.08 g |
| MT3 (inv.) | (III.7) | 208 | 157 | 196 | 78 | 5.11 g |
| MT4 (inv.) | (III.8) | 210 | 157 | 196 | 79 | 5.07 g |
| MT5 (inv.) | (III.9) | 207 | 153 | 196 | 78 | 5.07 g |

As becomes clear from the Table 1 an unambiguously improved image tone and an excellent covering power have been obtained for the materials having thin tabular grains. The more desired blue-black image tone is realize d by addition of the N-amino mercapto-triazole compounds in the protective antistress layer(s) of the material, in the huge amounts as set forth in the Table 1, wherein said amounts are moreover not disturbing the desired sensitometry.

EXAMPLE 2

A silver bromoiodide emulsion having thin tabular crystals was prepared following an analoguous precipitation scheme as in Example 1 hereinbefore, leading to tabular grains having an average diameter of 0.57 μm and an average thickness of 0.16 μm.

Coating solutions were added as in Example 1 and coating, exposure and processing was also performed in the same way.

Sensitometric parameters, just as in Table 1 have been given hereinafter in the Table 2, except for the data given with respect to the parameters DLT, expressing density latitude (measured between minimum and maximum density) and Gradation (contrast) "GG2", given as an integer after having multiplied with a factor of 100 the real gradation—contrast—figure as measured between a density of 1.0 and 2.0 above minimum density.

Moreover the same sensitometric data have been measured after having preserved said materials for 12 days at 45° C. and 70% RH.

TABLE 2

| Matl. | Compnd | F | S | GG2 | DLT | IT | F45/70 | S45/70 | DLT | GG2 |
|---|---|---|---|---|---|---|---|---|---|---|
| MT6 | NO | 196 | 155 | 367 | 357 | 197 | 227 | 149 | 354 | 328 |
| MT7 | (II) | 202 | 154 | 369 | 360 | 199 | 217 | 153 | 368 | 312 |

As becomes clear from the data given in Table 2 improvement of image tone is consolidated and it has moreover been established that preservation of the inventive material does not negatively influence sensitometry.

The processing was further run for both Materials MT6 and MT7 in the developer A the composition of which is given hereinafter followed by fixing in fixer A' (see composition given hereinafter) and rinsing at the indicated temperatures of 32° C. and 35° C. respectively for a total processing time of 90 seconds.

| Developer A | |
|---|---|
| 1-phenyl-4-methyl-4'hydroxy-methyl-pyrazolidine-3-one | 2 g/l |
| Sodium EDTA | 3.3 g/l |
| Potassium bromide | 1 g/l |
| Potassium thiocyanate | 33 g/l |
| Potassium sulphite | 96 g/l |
| Potassium carbonate | 20 ml/l |
| Polyglycol (M.W. = ca. 400) | 1 g/l |
| Ascorbic Acid | 50 g/l |
| pH ready-for-use: | 10.0 |

| Fixer A' | |
|---|---|
| Ammonium thiosulphate | 710 ml |
| (60% solution, wherein 1 ml comprises 0.778 g) | 80 g |
| Sodium metabisulphite | 130 g |
| Sodium acetate | 31 ml |
| Acetic acid pH ready-for-use (after dilution 1 + 3): | 4.90 |

TABLE 3

| Matl. | F32 | F35 | S32 | S35 | DLT32 | DLT35 | GG2/32 | GG2/35 |
|---|---|---|---|---|---|---|---|---|
| MT6 | 196 | 201 | 167 | 159 | 321 | 316 | 307 | 309 |
| MT7 | 196 | 198 | 171 | 163 | 345 | 348 | 325 | 342 |

From the data in Table 3 it becomes clear that in the presence of the N-amino mercaptotriazole compound according to the general formula (I) an improved developability is attained as the shoulder gradation is remarkably enhanced for inventive material MT7 if compared with the fairly unchanged gradation for comparative material MT6.

Having described in detail preferred embodiments of the current invention, it will now be apparent to those skilled in the art that numerous modifications can be made therein without departing from the scope of the invention as defined in the appending claims.

What is claimed is:

1. Radiographic silver halide film material comprising a transparent film support having first and second major surfaces coated with a subbing layer, optionally overcoated with an antihalation undercoat, further coated adjacent to said subbing layer or said antihalation layer, on each side of said film support a light-sensitive silver halide emulsion overcoated with a protective antistress layer, said emulsion layer having chemically and spectrally sensitized {111} tabular hexagonal grains or crystals having silver iodide in an amount of at most 3 mole %, based on silver, covering at least 50% of the total projective surface of all grains, the said tabular grains having a mean equivalent volume diameter of from 0.3 $\mu$m up to 1.0 $\mu$m and an average grain thickness of less than 0.30 $\mu$m, wherein said film material is coated with a total amount of silver halide, expressed as an equivalent amount of silver nitrate of less than 7 g/m$^2$, characterized in that said protective antistress layer, said antihalation undercoat or both said protective antistress layer and said antihalation undercoat comprise, in an amount of at least 0.5 mmole per mole of silver halide coated, a N-amino mercapto-triazole compound according to formula (I):

(I)

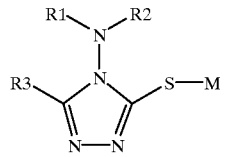

wherein M represents a hydrogen atom, an alkali metal atom or an ammonium group; and, wherein R3 represents hydrogen, an alkylene, alkenylene, alkynylene, arylene, heteroarylene, and wherein R1 and R2 together represent a double bond further independently substituted as R3 and wherein, at least one of R1/R2 or R3, contains one or more alkali soluble group(s).

2. Material according to claim 1, wherein said protective antistress layer and/or said antihalation layer, if present, comprises said amino mercapto-triazole compound in an amount of from 1 mmole up to 10 mmole per mole of silver halide coated.

3. Black-and-white image-forming method comprising the steps of contacting the film material according to claim 1 with X-ray intensifying screens by putting it in a sandwich of a pair of said X-ray intensifying screens in order to get a radiographic screen/film combination according to claim 1 or 2, exposing the film material to X-rays passing a subject to be examined, while being in contact with the said screens;

processing the film material by the steps of developing, fixing, rinsing and drying.

4. Radiographic silver halide film material comprising a transparent film support having first and second major surfaces coated with a subbing layer, optionally overcoated with an antihalation undercoat, further coated adjacent to said subbing layer or said antihalation layer, on each side of said film support a light-sensitive silver halide emulsion overcoated with a protective antistress layer, said emulsion layer having chemically and spectrally sensitized {111} tabular hexagonal grains or crystals having silver iodide in an amount of at most 3 mole %, based on silver, covering at least 50% of the total projective surface of all grains, the said tabular grains having a mean equivalent volume diameter of from 0.3 μm up to 1.0 μm and an average grain thickness of less than 0.30 μm, wherein said film material is coated with a total amount of silver halide, expressed as an equivalent amount of silver nitrate of less than 7 g/m$^2$, characterized in that said protective antistress layer, said antihalation undercoat or both said protective antistress layer and said antihalation undercoat comprise, in an amount of at least 0.5 mmole per mole of silver halide coated, a N-amino mercapto-triazole compound is represented by formula (II).

(II)

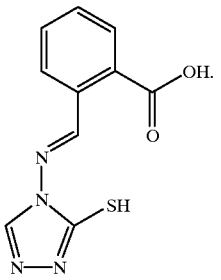

5. Material according to claim 1, wherein the said chemically and spectrally sensitized {111} tabular hexagonal grains have an average grain thickness of from 0.05 μm up to 0.25 μm.

6. Material according to claim 1, wherein said grains have been made sensitive to the ultraviolet and/or blue range of the wavelength spectrum.

7. Material according to claim 1, wherein said grains have been made sensitive to the green region of the wavelength spectrum.

8. Radiographic screen/film combination comprising a radiographic film material according to claim 6, sandwiched between a pair of supported or self-supporting X-ray intensifying screens, characterized in that i) said pair of supported or self-supporting X-ray intensifying screens essentially consists of luminescent phosphor particles emitting at least 50% of their emitted radiation in the wavelength range shorter than 420 nm, ii) said film comprises {111} tabular silver halide grains, spectrally sensitive to irradiation in the said wavelength range shorter than 420 nm by the presence of at least one J-aggregating blue spectral sensitizer and of at least one the non-J-aggregating dye selected from the group consisting of azacyanine dyes and monomethine cyanine dyes.

9. Radiographic screen/film combination comprising a duplitized film material according to claim 7, sandwiched between a pair of supported or self-supporting X-ray intensifying screens, characterized in that i) said pair of supported or self-supporting X-ray intensifying screens essentially consists of luminescent phosphor particles emitting at least 50% of their emitted radiation in the green wavelength range from 500 nm to 550 nm, ii) said film comprises {111} tabular silver halide grains, spectrally sensitive to irradiation in the said wavelength range from 500 to 550 nm by the presence of at least one J-aggregating green spectral sensitizer and of at least one non-J-aggregating dye selected from the group consisting of azacyanine dyes and monomethine cyanine dyes.

* * * * *